United States Patent [19]

Ono

[11] 4,270,710

[45] Jun. 2, 1981

[54] RESILIENTLY COMPRESSIBLE BOBBIN

[75] Inventor: Nobutaka Ono, Ashiya, Japan

[73] Assignee: Osaka Bobbin Kabushiki Kaisha, Osaka, Japan

[21] Appl. No.: 72,531

[22] Filed: Sep. 4, 1979

[30] Foreign Application Priority Data

Apr. 27, 1979 [JP] Japan ..... 54/57924[U]

[51] Int. Cl.[3] ..... B65H 75/14

[52] U.S. Cl. ..... 242/118.11; 68/198

[58] Field of Search ..... 242/118.1, 118.11, 118.2, 242/118; 68/189, 198

[56] References Cited

U.S. PATENT DOCUMENTS

| | | | |
|---|---|---|---|
| 3,563,491 | 2/1971 | Hahm | 242/118.11 |
| 3,753,534 | 8/1973 | Ono et al. | 242/118.11 |
| 3,756,532 | 9/1973 | Draper | 242/118.11 |
| 3,777,515 | 12/1973 | Hattori | 68/198 |
| 4,181,274 | 1/1980 | Burchette, Jr. | 242/118.11 |

FOREIGN PATENT DOCUMENTS

| | | | |
|---|---|---|---|
| 2408949 | 9/1975 | Fed. Rep. of Germany | 242/118.11 |

*Primary Examiner*—Leonard D. Christian

*Attorney, Agent, or Firm*—Blanchard, Flynn, Thiel, Boutell & Tanis

[57] ABSTRACT

A resiliently compressible bobbin comprising two end rings disposed opposite to one another in a spaced relationship, a plurality of transverse ring frames distributed equidistantly between and in parallel with the end rings and a plurality of straight longitudinal frames interconnecting the end rings and distributed equidistantly around the periphery of the bobbin. The longitudinal frames each have a thickness gradient decreasing radially outwardly, are flush with the end ring's inner and outer peripheral surfaces and are constructed so that portions on opposite sides of a transverse ring frame are gradually increased in thickness toward the transverse ring frame in the same direction, but in opposite directions relative to the portions on opposite sides of the adjacently disposed transverse ring frame, the midportion between transverse ring frames being narrowed. The longitudinal frame portions that extend on opposite sides of a transverse ring frame adjacent to the end ring or a transverse ring frame located every two frames from a frame ring adjacent an end ring are bent to define jointly a V-shape. The bobbin bends in a regular, definite direction upon compression and can be wound with yarn directly from yarn cops under high tension.

3 Claims, 11 Drawing Figures

FIG. 3
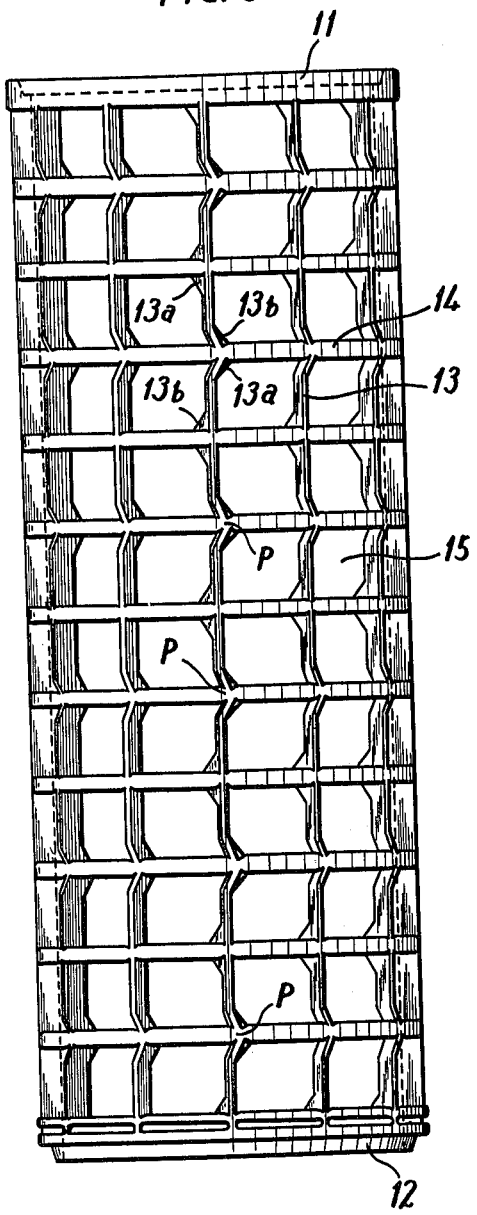
FIG. 5
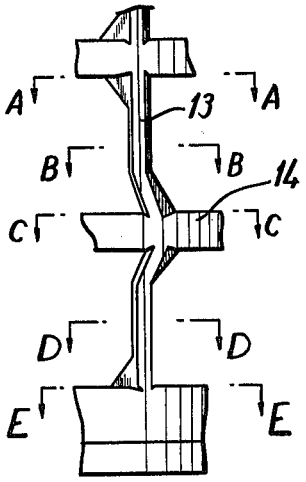
FIG. 6a
FIG. 6b
FIG. 6c
FIG. 6d
FIG. 6e
FIG. 4
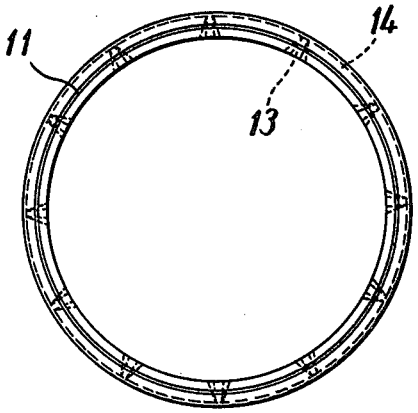

RESILIENTLY COMPRESSIBLE BOBBIN

This invention relates to a resiliently compressible bobbin for yarn treatment which has a good compressive resistance, is capable of assuming an accurate compression length and a regular buckling direction when compressed and is suited for performing uniform dyeing or other treatment.

In accomplishing uniform dyeing or heat treatment of acrylic or other synthetic fiber yarns or crimped yarns, it has heretofore been the general tendency to perform a soft winding upon winding up yarns on a bobbin in order to make the treating fluid flow smoothly through the bobbin.

Based on a so-called compressible bobbin which is resiliently compressible in the axial direction, a method for performing dyeing has been recently proposed which comprises winding up yarns on the bobbin and compressing, the bobbin during dyeing thereby releasing the tension of the yarns. In that method, however, the aforesaid soft winding technique has still been performed as an indispensable means for ensuring uniform dyeing.

Prior to the practice of the soft winding operation, a preliminary step to dyeing has usually been processed at a spinnery or a chemical fiber plant, which comprises winding spun yarns on a wood spindle and thereafter rewinding the yarn cops on a compressible bobbin. With a recent trend toward elimination or simplification of various preliminary steps such as the rewinding step, however, it has been attempted to wind up yarn cops as spun directly onto a compressible bobbin to transport the yarn package to a dye works. In this case, when the soft winding operation is applied to the direct winding-up step onto the compressible bobbin, it was often inconvenient to handle the wound yarns because of the yarn package collapsing during transportation or because of its large volume or mass.

A further improvement in the winding-up technique on a compressable bobbin has been desired and investigated to enhance the yarn winding density on the bobbin.

On the other hand, compressible bobbins currently available and in use have a construction susceptible of compression in which the longitudinal frames are formed to be bent in wavy form or in U-shape, so that they lack compressive resistance. When yarns are wound up on such a compressible bobbin at a high winding density, the bobbin thus wound up becomes shortened in the axial direction owing to the high tension during winding and it is detached from the winder. Moreover, such a compressible bobbin, when wound up, is not always buckled uniformly and regularly in its longitudinal frames when compressed, so that it cannot be compressed normally. Consequently, such uneven compression causes uneven yarn treatment and besides, the yarn of the inner winding layer is caught in and pinched or snagged by the buckled longitudinal frames and eventually is broken.

In view of the prior art drawbacks described above, the inventor has previously provided a compressible bobbin which does not cause abnormal deformation even when wound up at high density and which impedes the collapse of the wound yarns during transportation by means of the winding of yarns at high density therearound, thereby making it convenient to handle the yarn package.

This invention provides a further improvement in the foregoing compressible bobbin proposed previously be me and an important object thereof is to provide a resiliently compressible bobbin with which a uniform and regular buckling form or state is ensured when compressed.

The invention will be hereinafter described in more detail with reference to the accompanying drawings in which:

FIG. 1 is a schematic elevational view of a prior art compressible bobbin;

FIGS. 2*a* and 2*b* are fragmentary views of the bobbin of FIG. 1, respectively, showing normal and abnormal buckling states of the bobbin when compressed;

FIG. 3 is a schematic elevational view of one embodiment of a compressible bobbin according to the present invention;

FIG. 4 is a top plan view of the compressible bobbin shown in FIG. 3;

FIG. 5 is an enlarged view of the essential parts of the bobbin of FIG. 3; and FIGS. 6 (*a*), (*b*), (*c*), (*d*) and (*e*) are cross-sectional views taken along the lines A—A, B—B, C—C, D—D and E—E of FIG. 5, respectively.

Figure 1:
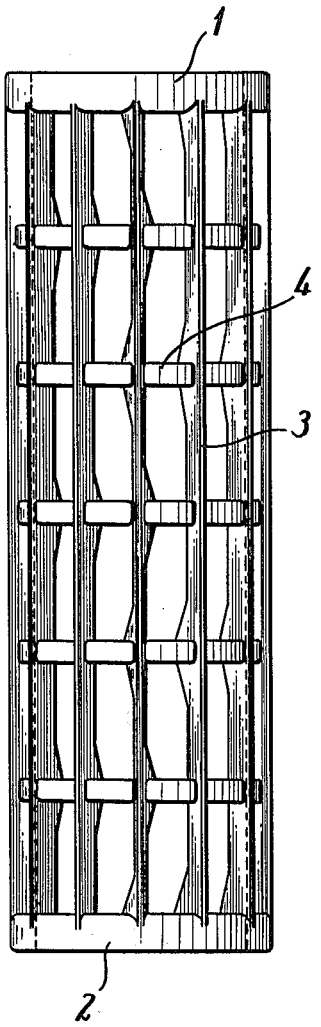
FIG. 1 Prior Art

Referring to FIG. 1, the prior art compressible bobbin comprises two end rings 1, 2 disposed opposite to one another and spaced apart a required distance. A plurality of straight longitudinal frames 3 extend between the end rings 1, 2 and are disposed in parallel with the central axis of the end rings 1, 2 and, in a circumferential, direction are equidistantly spaced apart from each other. A plurality of annular transverse frames 4 are disposed equidistantly between and in parallel with the end rings 1, 2 and interconnect the longitudinal frames 3. Each transverse frame 4 has its inner peripheral surface, in the surface including the inner peripheral surfaces of the end rings 1, 2 and the longitudinal frames 3, whereas its outer peripheral surface is located inwardly of the outer peripheral surfaces of the end rings 1, 2 and the longitudinal frames 3.

Each straight longitudinal frame 3 has its inner and outer peripheral surfaces, flush with the inner and outer peripheral surfaces of the end rings 1, 2, respectively, and has a thickness gradient decreasing gradually in a cross-section parallel with the end rings 1 and 2, from the radial center toward the outer periphery. A section of the longitudinal frame 3 extending between an adjacent end ring and transverse frame 4 or between adjacent transverse frames 4 is formed to be thickened progressively in symmetrically opposite directions at the portions close to the end ring or the transverse frame, between which portions the intermediate portion of the frame is narrowed, and any contiguous two sections of a longitudinal frame are increased in thickness in the same direction at the respective portions on opposite sides of the intervening transverse frame.

Figure 2A:
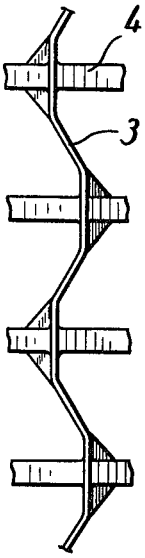
FIG. 2a Prior Art
Figure 2B:
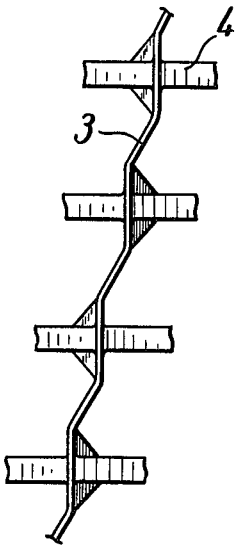
FIG. 2b Prior Art

However, when this conventional compressible bobbin is, in practice, compressed in performing dyeing or any treatment, a distortion phenomenon often occurs, in that the bobbin is buckled in the eccentric axis direction, as shown in FIG. 2(*b*), notwithstanding that a uniform buckling state of a zigzag configuration as shown in FIG. 2(*a*) was contemplated. Thus, the phenomenon not only affects adversely the yarns wound around the bobbin, but causes uneven treatment.

Now referring to FIG. 3, the reference numerals 11, 12 designate end rings at both terminals of the bobbin, 13 designates a longitudinal frame interconnecting the end rings 11, 12, and 14 designate a transverse ring frame disposed in the plane intersecting the longitudinal frame 13 at a right angle and located between the end rings 11, 12. The end rings 11, 12, a plurality of longitudinal frames 13 and a plurality of transverse ring frames 14 constitute the fundamental construction of the compressible bobbin of this invention.

The bobbin is made of a synthetic resin, e.g. polypropylene or polyethylene, and is shaped integrally by means of a conventional molding process.

The end rings 11, 12 are disposed opposite to one another and are spaced apart a required distance, thereby determining the length of the bobbin.

The outer end contours of the end rings 11 and 12 may be shaped to be smooth or otherwise concave and convex at the upper and lower ends, respectively, as shown, so that the bobbins may be stacked one upon another by the engagement of the concave part of one bobbin and the convex part of another bobbin.

In particular, in FIG. 3, the end rings 11, 12 are shaped to be concave and convex, respectively so that the bobbin can be engaged or disengaged readily when stacking. Upon stacking the bobbins, a spacer ring may also be interposed therebetween.

A plurality of the longitudinal frames 13 are each disposed rectilineally in parallel with the central axis of the cylindrical surface defined by both the end rings 11 and 12 and are, in a circumferential direction, equidistantly distributed around the cylindrical surface.

The longitudinal frames 13 are, in their inner and outer surfaces, flush with the inner and outer peripheral peripheral surfaces of the end rings 11, 12, respectively, and have a thickness gradient tapering, in the cross-section intersecting at right angles with the central axis of the end rings, from the center toward the outer periphery thereof, as shown in FIG. 4.

Each longitudinal frame 3 is subdivided by the transverse ring frames 14 into a number of longitudinal frame sections. Each section of the longitudinal frame 13 extending between any adjacent end ring 11, 12 and transverse frame 14 or between adjacent transverse frames 14, 14 is constructed so that both the portions close to the adjacent transverse elements are gradually increased in thickness in symmetrically opposite directions toward the adjacent transverse elements as shown at 13*a* and 13*b* and the midportion of the frame section is narrowed as shown in FIGS. 5 and 6.

In any two contiguous sections of a longitudinal frame 13, between which a transverse ring frame 14 intervenes and intersects, the thickness increasing direction is the same for the respective portions on opposite sides of the interventing transverse ring frame. FIGS. 6 (*a*), (*b*), (*c*), (*d*), and (*e*) show the states of variation in thickness of a longitudinal frame 13.

Aside from the foregoing feature of the construction, the longitudinal frame 13 has a further essential feature that at the junctions (P) of the longitudinal frames 13 and the transverse ring frames 14 adjacent to the end rings 11, 12 and at the junctions (P) of the longitudinal frames 13 and the transverse ring frames 14 located every two transverse ring frames from the transverse frame next to the end ring, the longitudinal frames are formed to be bent in a V-shape, as shown in FIG. 3, so that the intervening transverse ring frame, acts as a buckling-bending center when compressed. In that figure, the bend direction of the longitudinal frames at these junctions P are the same direction.

On the other hand, each transverse ring frame 14 is, in its inner peripheral surface, flush with the inner peripheral surfaces of the end rings 11, 12 and the longitudinal frames 13, and is, in its outer peripheral surface, flush with the outer peripheral surfaces of the end rings 11 and 12 and the longitudinal frames 13 or is disposed inwardly of the outer peripheral surface. It extends in an annular manner, interconnecting the longitudinal frames 13.

Preferably, the transverse ring frame 14 is rounded off on the upper and lower margins.

In FIG. 3, the reference numeral 15 designates openings for passing treating liquid therethrough.

The resiliently compressible bobbin thus constructed in accordance with this invention, in advance of dyeing or other treatment, has yarn wound up thereon directly from yarn cops at a spinnery or has yarn wound up thereon in a conventional way by a rewinding operation. In either case, the bobbin is preferred to be stressed by means of the maximum tension applied upon winding, and is thus wound up in a high winding density and at high tension.

The compressible bobbin having the winding yarn layers is then compressed in an axial direction by applying pressure thereto. The narrow midportions of the longitudinal frame sections are, upon compression, most susceptible of buckling. Under the compresion state, the buckling develops in the same direction at the thickened portions on opposite sides of every intervening transverse ring frame with the aid of the V-shape bent construction provided at every other longitudinal frame. During this compression, when the longitudinal frames are buckled in chair-form configuration between the adjacent transverse ring frames, they lean in a regular direction so that contiguous longitudinal frame sections approach each other and the thickness increasing directions both at the upper area above the buckling point and at the lower area below the buckling point are mutually symmetrical. This will result in uniform compression. Further, yarn is prevented from being caught and pinched in the bobbin since the longitudinal frames have a thickness gradient tapering toward the outer periphery and the transverse ring frames are located inward of the outer peripheral surface whereby interstices are defined in the outer periphery of the bobbin.

When the compressible bobbin in the state of compression is finally subjected to dyeing or any treatment, smooth and even treatment is thus attainable, notwithstanding the high density winding.

In accordance with this invention, the compressible bobbin has a greater resisting force against the compression as compared with the prior art wavy bent or U-shape bent longitudinal frames because of its rectilinear longitudinal frame 13, and it can be wound up with yarn while holding its normal shape or state without undergoing any abnormal deformation even when the yarn exerts by a high tension thereupon. Because of this feature, it is necessary to apply a little larger force to the bobbin for compression than is the case with conventional compressible bobbins.

As thus far described, the resiliently compressible bobbin designed according to this invention has many advantages and is useful. Even when the bobbin is wound under a higher tension than that used with conventional bobbins, there is no danger that the particular longitudinal frame structure will undergo abnormal deformation due to the yarn tension.

The compressible bobbin is well suited for directly winding yarn cops thereon, which contributes to the simplification of dyeing steps or other treatment steps. Furthermore, it is convenient to handle the wound up bobbin since the volume or mass is relatively small and the yarn package never collapses during transportation.

Owing to the above-described longitudinal frame construction having the V-shape configuration and the thickness gradient, the resiliently compressible bobbin can lean or buckle in a regular direction upon compression, so that the distortion phenomenon, often experienced with conventional compressible bobbins, can be completely impeded. Since the outer periphery of the bobbin is defined by interstices, the yarns are prevented from being pinched or snagged in the bobbin.

Thus, in accordance with the compressible bobbin of this invention, uniform treatment or dyeing as well as improvement in process steps is easily attainable.

What I claim is:

1. A resiliently compressible bobbin comprising two end rings disposed opposite to one another and spaced a required distance apart from one another, a plurality of rectilinear longitudinal frames connecting the end rings which longitudinal frames are equidistantly distributed around the circumference of said end rings and are parallel with the central axis of the end rings, and a plurality of transverse ring frames equidistantly spaced apart from each other in parallel with and between the end rings, each of said transverse ring frames being annular and interconnecting the longitudinal frames, wherein said rectilinear longitudinal frames have inner and outer peripheral surfaces flush with the inner and outer peripheral surfaces of the end rings, respectively, and have a thickness gradient tapering, in a cross-sectional plane parallel with the end ring, from the radial center toward the outer periphery thereof, and are subdivided by the transverse ring frames into a number of longitudinal frame sections which each extend between an adjacently disposed end ring and transverse ring frame or between adjacently disposed transverse ring frames, wherein each said longitudinal frame section is, at the portions close to the connections thereof with said adjacently disposed end ring and transverse ring frame or with said adjacently disposed transverse ring frames, progressively increased in thickness in symmetrically opposite directions toward said connections and the midportion of said longitudinal frame section is narrowed between said portions, any contiguous two of said longitudinal frame sections having an intervening transverse ring frame therebetween are, at the respective portions on opposite sides of the intervening transverse ring frame, thickened increasingly in the same direction relative to said intervening transverse ring frame and wherein any contiguous two of said longitudinal ring frame sections that have therebetween an intervening transverse ring frame disposed adjacent to an end ring or located every two transverse ring frames from a said transverse ring frame adjacent to an end ring jointly define a V-shaped bend at the respective increasingly thickened portions on opposite sides of said intervening transverse ring frame, thereby providing a middle point between buckling-bending points when said bobbin is compressed.

2. A resiliently compressible bobbin as claimed in claim 1, wherein said transverse ring frames have outer peripheral surfaces spaced radially inward of the outer peripheral surfaces of said longitudinal frames and said end rings.

3. A resiliently compressible bobbin as claimed in claim 1, wherein said two end rings are concave and convex, respectively, in their axially outer ends so that said bobbins may be engaged in a stacked, end-to-end relationship.

* * * * *